US006383337B1

(12) United States Patent
Meinecke et al.

(10) Patent No.: US 6,383,337 B1
(45) Date of Patent: May 7, 2002

(54) METHOD AND DEVICE FOR APPLYING A MEDIUM ON A RUNNING WEB OF MATERIAL

(75) Inventors: Albrecht Meinecke; Volker Schmidt-Rohr; Ingolf Cedra, all of Heidenheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/331,173

(22) PCT Filed: Oct. 22, 1998

(86) PCT No.: PCT/DE98/03096

§ 371 Date: Jun. 22, 1999

§ 102(e) Date: Jun. 22, 1999

(87) PCT Pub. No.: WO99/22067

PCT Pub. Date: May 6, 1999

(30) Foreign Application Priority Data

| | | |
|---|---|---|
| Oct. 24, 1997 | (DE) | 297 23 289 U |
| May 8, 1998 | (DE) | 198 20 582 |
| May 27, 1998 | (DE) | 198 23 724 |

(51) Int. Cl.[7] ..... D21H 23/28; D21H 23/70

(52) U.S. Cl. ..... 162/183; 162/184; 162/186; 162/173; 162/175; 162/181.1; 162/181.2; 162/135; 162/202; 162/275; 162/266; 162/301; 162/381

(58) Field of Search ..... 162/298–301, 162/275, 265–266, 186, 135, 119, 183, 110, 184, 202–204, 185, 208, 381, 176, 173, 181.1–181.6; 427/479, 449, 475, 209, 211, 365; 118/300, 313, 324, 325, 261, 203, 359

(56) References Cited

U.S. PATENT DOCUMENTS

| | | |
|---|---|---|
| 1,587,027 A | 6/1926 | O'Brien |
| 1,662,641 A | 3/1928 | Hans |

(List continued on next page.)

FOREIGN PATENT DOCUMENTS

| | | |
|---|---|---|
| DE | 3146828 | 6/1983 |
| DE | 4340039 | 4/1994 |

(List continued on next page.)

*Primary Examiner*—Jose Fortuna
(74) *Attorney, Agent, or Firm*—Greenblum & Bernstein, P.L.C.

(57) ABSTRACT

A papermaking machine and a method for applying an application medium to a moving web of material in a papermaking machine. The papermaking machine has a wet end section, a press section, a drying section and an applying device for applying a medium to a moving web of material. The wet end section includes a twin wire area having a first wire and a second wire wherein the web of material is formed and positioned between the two wires and separated from the two wires before moving to the press section. At least one wet end section applying device is positioned on one side of at least one of the first wire or the second wire within the twin wire area and facing away from the web of material positioned on the wires. The press section of the papermaking machine has a first press element and at least one press section applying device facing directly toward the web of material. The method includes forming a web of material in a twin wire area of a wet end section of the papermaking machine, applying at least one first medium with at least one wet end section applying device to at least one side of the web of material within the twin wire area of the wet end section of the papermaking machine, moving the formed web of material to the press section of the papermaking machine, and applying at least one second medium to the formed web of material with at least one press section applying device after the web of material passes a first press element of a press section of the papermaking machine.

27 Claims, 3 Drawing Sheets

U.S. PATENT DOCUMENTS

| | | | | | |
|---|---|---|---|---|---|
| 1,966,458 | A | * | 7/1934 | Novak | 162/170 |
| 1,996,832 | A | * | 4/1935 | Rosmait | 162/266 |
| 1,999,049 | A | * | 4/1935 | Hedstrom, Jr. | 162/266 |
| 2,711,120 | A | * | 6/1955 | MacLaurin | 162/110 |
| 3,146,159 | A | | 8/1964 | Muggleton | |
| 3,560,334 | A | * | 2/1971 | Arledter | 162/266 |
| 4,793,899 | A | | 12/1988 | Skaugen | |
| 5,152,872 | A | | 10/1992 | Racine et al. | |
| 5,622,599 | A | | 4/1997 | Sproule et al. | |

FOREIGN PATENT DOCUMENTS

| | | |
|---|---|---|
| DE | 29621877 | 3/1997 |
| DE | 29723289.4 | 3/1999 |
| DE | 19747091 | 4/1999 |
| EP | 815948 | 1/1998 |

* cited by examiner

METHOD AND DEVICE FOR APPLYING A MEDIUM ON A RUNNING WEB OF MATERIAL

BACKGROUND OF THE INVENTION

1. Field of the Invention

The invention relates to a method for applying a liquid or pasty application medium on a running web of material, especially of paper or cardboard, and a paper machine with a device suitable for implementing the method.

2. Discussion of Background Information

U.S. Pat. No. 5,152,872 teaches that a one-sided application is made directly onto the fiber web with a roll application mechanism in a single-wire wet splitting device. In the application area, the wire loops around a roll supporting the web. The web lies on the side of the wire facing away from the roll. The roll application mechanism contacts the web in the looping area of the supporting roll. The roll application mechanism is a device having three rolls. Moreover, in the gap between the actual applicator roll and the web of material that has already been wetted, during the detachment process of the applicator roll surface from the web surface, roughening or picking occurs on the web surface. In this patent, it is not possible to apply an application medium in a twin wire area of a wet splitting device.

U.S. Pat. No. 4,793,899 discloses a similar applying device, as described above. In this patent, however, the application is made not in the wet splitting device but in the press section of a paper or cardboard machine. Moreover, the application mechanism applies the application medium with a machine-wide stream onto a combined application-and-press roll. Then this roll transfers the application medium to the web of material. This construction also causes picking on the web of material and in any event does not permit application in the twin wire area of a paper machine.

U.S. Pat. No. 5,622,599 teaches that a one-side application with spray nozzles from above directly onto the still-wet web in the wire section of a paper machine. The spray application occurs in the area of the straight wire course, in which wire washboard marks can form in part transverse with respect to the wire direction. In this manner, the spray application can occur irregularly on the surface of the web of material (viewed transversely with respect to the direction in which the wire moves). This construction also does not include application in a twin wire area. Moreover, a roll downstream from the spray application mechanism contacts the wetted web of material and results in the disadvantages picking problem described above.

An applying device is described in the as yet unpublished German patent applications DE 197 47 091 and DE 297 23 289, in which the application medium is applied to the still-wet web of material in an area supported by a roll. In so doing, the web of material can lie both between two wires and also on one wire only. If the surface of the web of material is covered by a wire, for example, the applying device feeds the application medium of the surface of the web of material through the wire. An additional application possibility is to apply the medium indirectly onto the web of material. Here, with the application mechanism, the medium is first applied to the surface of the roll supporting the wire. Through the rotation of the roll, the application medium is then fed through the supporting wire to the surface of the web of material. This application method is used, for example, if the surface of the web of material that faces away from the roll is not covered by a wire. The application media can be, for example, color coatings, starches, or also other substances. The disclosure content of the application specified above is incorporated in its entirety in this application.

Extremely high paper surface strengths are required particularly for heat-set and cold-set offset printing. In the prior art, the pigment particles of the color coating are only moderately anchored to the surface of the web of material. During printing, picking then occurs on the surface of the web of material, since the fiber and pigment particles are often held more strongly by the printing ink than by the web of material. In this process, fluffing or delaminating (i.e., separation of layers) partially occurs. This results in rather significant unevenness in the printed image.

SUMMARY OF THE INVENTION

The invention therefore provides for a method and a device in which an improved anchoring of the application medium on the web of material is achieved, so that its printability is improved and the technical outlay is reduced to the extent possible with respect to previous solutions.

This achieved in accordance with the invention disclosed herein.

It is now recognized that the application, for example, of a color coating with a suitable bonding agent (for example, mineral filling materials such a kaolin, clays, talcum, zeolite, $CaCO_3$ or $TiO_2$, etc.) in the twin wire area of the wet end section of a paper or cardboard machine exhibits a good anchoring with the web of material. This occurs because in the wet end section, the fibers lie relatively loosely at first in relation to their final condition after drying. Through the dewatering pressure—caused by dewatering strips or by the traction of the wire on a curved wire path—water is more intensively driven from the fiber suspension. If, in this phase, the application medium is pressed with pressure through the wire into the fiber web via an applying device, the medium interlocks with the fibers of the surface of the web of material. Since some water is still present inside the web of material, the medium does not penetrate to the center of the web of material, but remains primarily in the outer layers. This results in a steep distribution of the medium in the z direction of the sheet of paper (i.e., over the flat cross-section), whereby the printability is significantly improved.

An applicator is used as an applying device in the twin wire area. This is a distributing pipe that is transverse with respect to the direction in which the wire moves and that has a slot-shaped nozzle that also extends in that direction. The medium is pressed out from the slot-shaped nozzle at a pressure of 0.05 to 0.5 bar—preferably at 0.1 to 0.4 bar. Since this applicator is positioned near or in the immediate vicinity of the elements, such as dewatering strips or rolls, which support the surface of the wire, wire washboard marks, which extend transversely with respect to the direction in which the wire moves, are eliminated. A wire surface smoothed in this way makes possible a very close positioning of the applicator to the wire surface. Even direct contact with the surface of the wire is possible. This even spacing between the applicator and the surface of the wire that can be realized in this manner results in homogenous hydrodynamic conditions when viewed across the width of the machine. In this manner, a high degree of smoothness of application is achieved transversely with respect to the direction in which the wire moves. The application weight (dry weight of the application medium) ranges from 1 to 10 $g/m^2$ per side, depending on the instance of utilization. The formed web of material has a solid content ranging from 5% to 50% or preferably ranging from 8% to 17%.

The application described above can be supported by a first addition of additives that have a surface bonding effect. These agents include, for example, starches, surface sizing agents, lattices, latex, and polyvinyl alcohols. These agents are applied jointly with the actual application medium or separately. Pre-dosing in the fiber material upstream from the headbox is also possible.

The present invention provides for a residual addition of the additives in an area of the paper machine in which the web of material already has a rather low moisture content high dry content. This leads to a higher retention of the additives in the web of material, since, owing to the low moisture content, less water flow from the web of material occurs. This applicator location is located preferably downstream from the first press element of the press section. The initial anchoring of the application medium in the twin wire area of the wet end section combined with a further application downstream with at least one additive results in an improved surface strength and thus an improved smoothness of the printed image. Furthermore, a reduced load of the water circuit of the paper machine is achieved since the additive remains more intensively in the web of material.

This combination of the measured application can also avoid the need for an additional sizing press or a coating machine.

The applicator mentioned above or spray nozzles can be used as applying devices for the additives.

The present invention provides for the application of fine fiber material in the twin wire area of the wet end section. In this manner as well, a surface bonding of the web of material is achieved. The fine fiber material is unintentionally washed out during dewatering—mainly from the surface of the web of material. Recirculating the fine fiber material causes it to be added back to the layer in the web of material from which it was lost. The fiber mat located between the wires thus functions as a filter. This fine fiber material can, for example, be recovered through fractionation of the wire water.

Additional embodiments of the invention may be ascertained by reviewing the present disclosure and the accompanying figures.

It is understood that the features of the invention specified above and to be explained below are not only applicable in the respectively indicated combinations, but also in other combination or individually, without exceeding the scope of the invention.

BRIEF DESCRIPTION OF THE DRAWINGS

Additional features and advantages of the invention are shown in the following description of embodiments, with reference to the drawings.

The invention is explained in further detail below, with reference to the drawings.

DETAILED DESCRIPTION OF THE PRESENT INVENTION

Figure 1:
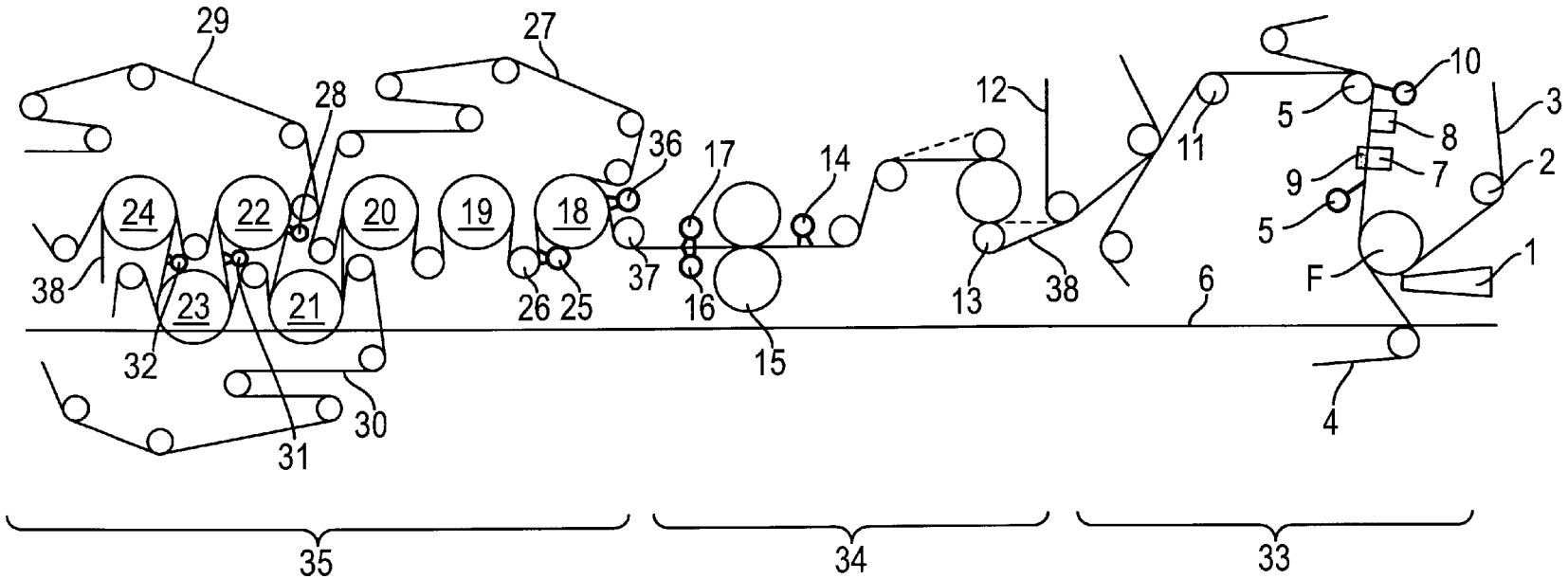
FIG. 1 shows a partial view of a paper or cardboard machine having examples of mounting locations of the applying devices.

In FIG. 1, the machine foundation is 6 and the fiber material suspension is produced between wires 3 and 4 via the headbox 1. On the radius of a deflection device F (such as a forming roll, for example), wires run on a slant toward each other and consequently encloses the fiber suspension between them. A first dewatering of the fiber suspension occurs here and a fiber mat 38 (web of material) forms. After the deflection device F, the twin area, the end point of which is located at the roll S, such as a wire suction roll. Additional dewatering elements 7, 8, and 9 may also be located in the twin wire area. The dewatering element 7 can be a dewatering box with stationary dewatering strips. Then, generally flexible, pressable dewatering strips 9 are positioned opposite dewatering box 7. Dewatering element 8 can, for example, be a wire suction box. The area of the twin wire area can also be curved. Applicators 5 and 10 positioned either on the wires 3 and 4 or possibly positioned at a slight distance from the wire surface can apply an application medium, to the already partially dewatered web of material 38 through the wire into the fiber web of the web of material. This application medium can contain color coatings, starches, surface-bonding media, or also fine fiber suspensions.

In order to ensure as accurate an application as possible from the applicators 5 and 10, they are preferably positioned in the vicinity of elements S, 7, 8 and 9 that are in contact with and hence support wire webs 3 and 4. These elements by supporting the wires prevent to the greatest possible extent a possible surface washboard mark of the wire transverse with respect to the direction in which the wire moves.

The structure of the applicators 5 and 10 is known from the prior art. They have a slot-shaped opening in the output direction for applying the application medium under pressure.

After the first application of an application medium in the wet splitting device 33, the web of material 38 is guided over another wire of press section 34. A continuous loop 12 transfers the web of material 38 to the press section 34. An additional transfer device (not shown), such as a blowing device, guides the web of material 38 along a course, indicated either as a broken or dotted line, through a first press element 13.

It is also particularly advantageous from this point forward that the applying devices 14, 16, and 17 of the press section 34 and also the subsequent applying devices in the drying section can directly apply a medium onto the surface of the web, since the web of material 38 already has sufficient tensile strength. The web of material does not necessarily have to be supported continuously by felts and thus is also not covered by felts or, later, drying wires. In addition to the applicators already mentioned, the applying devices can, from this point forward, also be spray nozzles arranged in a row transversely with respect to the direction in which the wire moves. An additional application location in the press section is the press gap of the press 15. Here, by utilizing an applying device on the press roll surface, the second application medium can be applied. Through the rotation of the press rolls, the medium is then transferred onto the surface of the web of material.

Downstream from the press section 34, a transfer device (not shown) forwards the web of material 38 around the paper guiding roll 37 to the drying section 35. In this process, drying cylinders 18, 19, 20, drying wire 27, and the drying web suction rolls 26 form a single-row, top-felted drying group. In the area where the web of material 38 lies exposed on drying cylinder 18 i.e., where it is not covered by drying wire 27, is a suitable place for positioning an applying device 36, since drying cylinder 18 supports the web of material. In a single-row drying group, there is respectively only one opportunity to perform an application directly onto the side of the web of material 38 facing away from the drying cylinder. As a rule, this is possible at the beginning or at the end. By looping the drying wire suction roll 26, the web of material 38 is caused to lie on the outside of drying wire 27 and is supported by the roll body. This position is also suitable for adding an additional applying device 25, in order to apply media for surface bonding the surface of the web.

Drying cylinders 21, 22, 23, and 24 are drying wires 29 and 30 have a double-row drying group which is shown partially. In this location, applying devices 28, 31, and 32 can be positioned in such a way between an upper and a lower drying cylinder that both surfaces of the web of material can always be treated alternately with application media.

This allows for the applying devices to be positioned both at the beginning and at the end areas of the drying group, in which the web of material is still lying on the drying cylinder and is therefore supported by the drying cylinder, and in the area where the web of material is located in transition between two drying cylinders, i.e., in the free drawing area.

Figure 2:
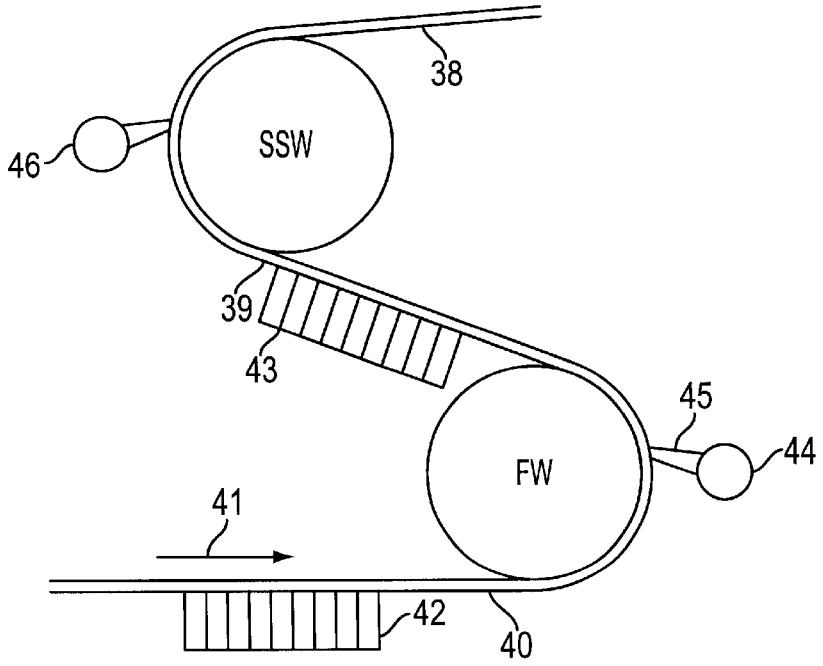
FIG. 2 shows a section of a twin wire area of a wet end section.

FIG. 2 depicts a twin wire area of a wet end section that differs from the one depicted in FIG. 1. The web of material 38 is located between the upper wire 39 and lower wire 40. Arrow 41 indicates the direction of movement. The web of material is dewatered alternately between dewatering elements 42 and 43, which are by way of example only. A first applicator 44 with its slot-shaped nozzle 45 is located on the circumference of a first roll, such as a forming roll FW, for example. If a second application in the wet end section is desired, an additional applicator 46 can be positioned in an additional twin wire area supported by a second roll, here a wire suction roll SSW.

Figure 2A:
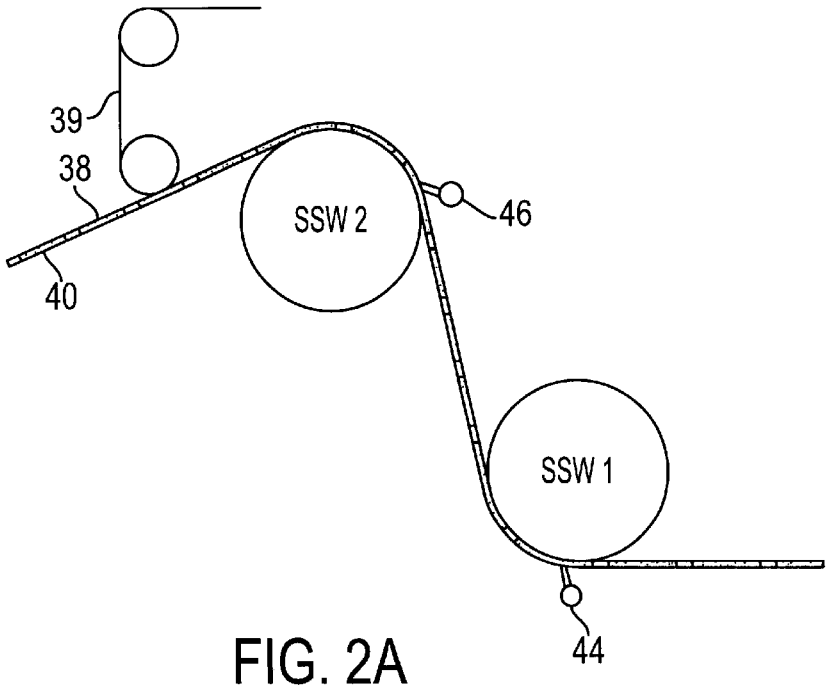
FIG. 2*a* shows a section of a twin wire area of a wet end section (further exemplary embodiment)

An additional embodiment of a twin wire area of a wet end section is shown in FIG. 2*a*. FIG. 2*a* depicts the double wire, comprising the upper wire 39 and lower wire 40, carrying emerging paper web between them. The paper web 38 is shown in dotted lines, whereas in FIG. 2, the paper web not shown separately in the interest of making the upper and lower wires clearly visible. The two wires run from the right over the first wire suction roll SSW1, on whose underside is positioned an applying device 44 that applies a medium to the underside of the paper web 38. Thereafter the double wire is forwarded to the second wire suction roll SSW2, which is looped from the side of the lower wire, whereby a second applying device 46 is positioned on the side of the upper wire 39, which simultaneously applies a second medium to the surface of the web of material 38. After passing, the second wire suction roll SSW2, the double wire is conveyed on a downstream deflection roll that lifts the upper wire 39 from the web of material, after which the emerging paper web 38 is conveyed onward lying on the lower wire 40.

Figure 3:
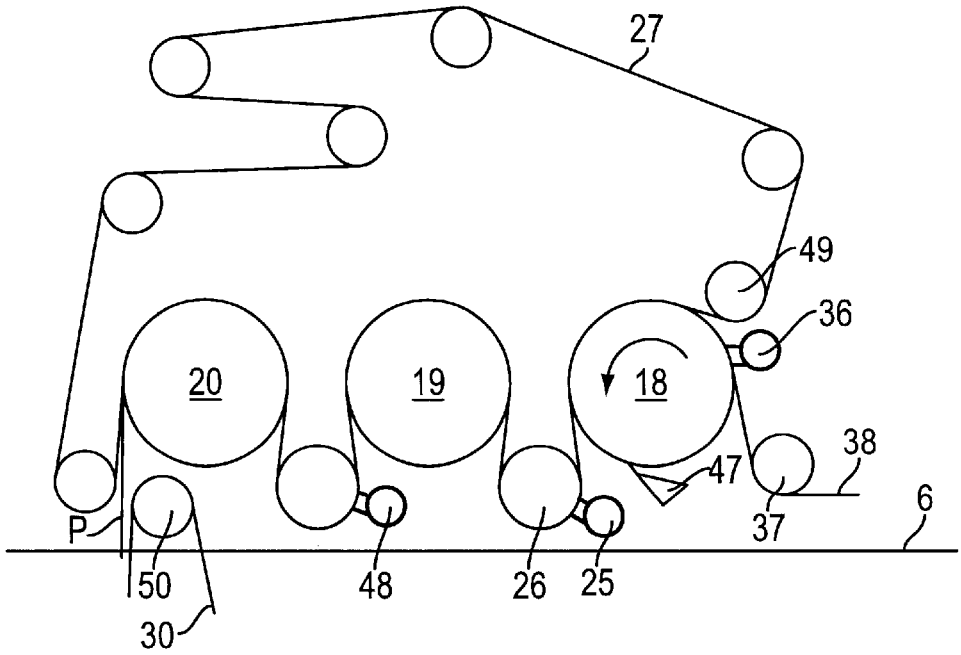
FIG. 3 shows a section of a single-row drying group.

FIG. 3 shows a partial enlargement of the single-row drying group from FIG. 1. After looping around the paper guiding roll 37, the web of material 38 moves toward drying cylinder 18. Drying wire guiding roll 49 is positioned high enough so that one side of the web lies freely on the cylinder surface. In this way, there is sufficient room to provide from applying device 36 to the surface of the web. In order to remove any contamination on the part of the applying device 36 on the surface of the drying cylinder 18, a cleaning ductor 47 is provided. Applying device 25 and any additional applying device 48 impinge upon the surface of the web of material 38 facing toward the cylinder surface. Lower drying wire 30 and its associated drying wire guiding roll 50 of the downstream double-row drying group can be seen at the left edge of FIG. 3.

Figure 4:
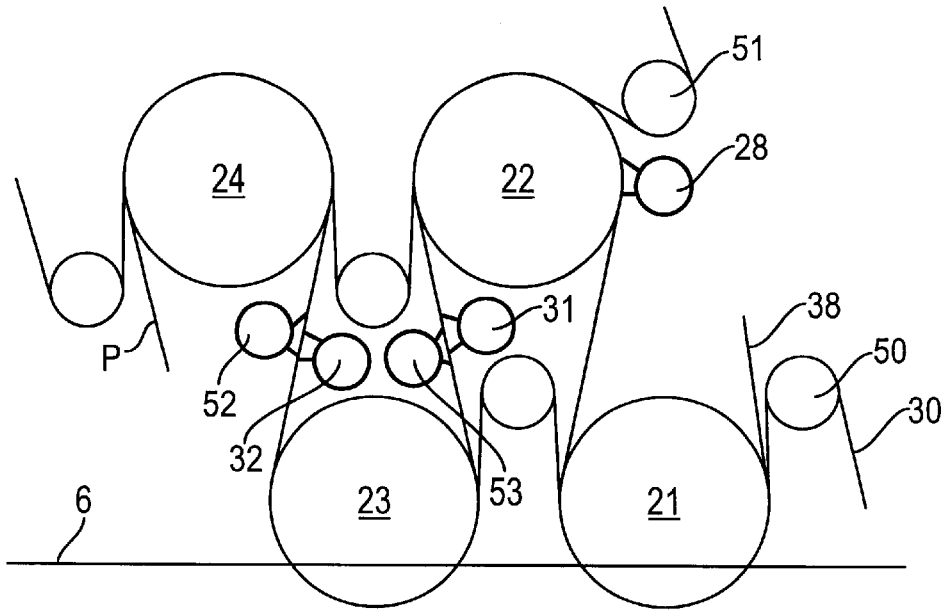
FIG. 4 shows a section of a double-row drying group.

FIG. 4 shows a partial enlargement of the double-row drying group from FIG. 1. The web of material 38 comes from the single-row drying group and first loops around drying cylinder 21. Drying wire guiding roll 51 is positioned high enough that the web of material 38 partially lies open on the cylinder surface of the drying cylinder. An applying device 28, which handles the application of the second medium, is provided to the open area of the web of material 38 supported by drying cylinder 22. In the free stretches of the web of material 3 8 between the upper and the lower rows of cylinders, additional applying devices 31, 32, 52, and 53 are positioned. In the process, the applying devices 31 and 32 are allocated to different surfaces of the web of material. Alternatively, the applying devices 52 and 53 can also be brought into use. In this example, in order to avoid additional tensile stresses in the web of material 38, the applying device 31 is arranged opposite an applying device 53.

The arrangements of the applying devices described above are applicable both for one-sided application and for two-sided application on the web of material.

| List of Reference Numbers | |
|---|---|
| 1 | headbox |
| 2 | wire guiding roll |
| 3 | wire |
| 4 | wire |
| 5 | applying device (applicator) |
| 6 | paper machine foundation |
| 7 | dewatering element (dewatering box) |
| 8 | dewatering element (wire suction box) |
| 9 | dewatering element (dewatering strips) |
| 10 | applying device (applicator) |
| 11 | wire guiding roll |
| 12 | continuous loop |
| 13 | first press element |
| 14 | applying device (applicator) |
| 15 | applying device (press) |
| 16 | applying device (applicator) |
| 17 | applying device (applicator) |
| 18 | drying cylinder drying cylinder |
| 19 | drying cylinder |
| 20 | drying cylinder |
| 21 | drying cylinder |
| 22 | drying cylinder |
| 23 | drying cylinder |
| 24 | drying cylinder |
| 25 | applying device (applicator) |
| 26 | drying wire suction roll |
| 27 | drying wire |
| 28 | applying device (applicator) |
| 29 | drying wire |
| 30 | drying wire |
| 31 | applying device (applicator) |
| 32 | applying device (applicator) |
| 33 | wet end section |
| 34 | press section |
| 35 | drying section |
| 36 | applying device (applicator) |
| 37 | paper guiding roll |
| 38 | web of material |
| 39 | upper wire |

-continued

| List of Reference Numbers | |
|---|---|
| 40 | lower wire |
| 41 | running direction |
| 42 | dewatering element |
| 43 | dewatering element |
| 44 | applying device (applicator) |
| 45 | slot-shaped nozzle |
| 46 | applying device (applicator) |
| 47 | cleaning ductor |
| 48 | applying device (applicator) |
| 49 | drying wire guiding roll |
| 50 | drying wire guiding roll |
| 51 | drying wire guiding roll |
| 52 | applying device (applicator) |
| 53 | applying device (applicator) |
| F | deflection device (forming roll) |
| S | wire suction roll |
| FW | forming roll |
| SSW | wire suction roll |

What is claimed is:

1. A method for applying an application medium to a moving web of material in a papermaking machine comprising:

forming a web of material in a twin wire area of a wet end section of the papermaking machine, wherein the web is produced from a material suspension in the twin wire area;

applying at least one first medium with at least one wet end section applying device to at least one side of the web of material within the twin wire area of the wet end section of the papermaking machine;

moving the formed web of material to a press section of the papermaking machine; and applying at least one second medium to the formed web of material in the press section with at least one press section applying device after the web of material passes a first press nip of the press section of the papermaking machine.

2. The method of claim 1, further comprising applying the at least one second medium at the end of the press section of the papermaking machine.

3. The method of claim 1, further comprising applying additional medium to the formed web of material with at least one drying section applying device within a drying section of the papermaking machine.

4. The method of claim 3, wherein the at least one first medium further comprises at least one of starch, a surface sizing agent, a latex, polyvinyl alcohol or an optical brightening agent.

5. The method of claim 1, wherein at least one of the first and the second medium comprises a pigment suspension.

6. The method of claim 5, wherein at least one of the first and the second medium further comprises at least one surface bonding additive.

7. The method of claim 6, wherein the at least one surface bonding additive is selected from a latex, a polyvinyl alcohol, or a starch.

8. The method of claim 1, wherein the at least one of the first and the second medium comprises at least one component from a wire water.

9. The method of claim 8, wherein the at least one of the first and the second medium further comprises a fine fiber material suspension.

10. The method of claim 9, further comprising producing the at least one of the first and the second medium from the flow of the wire water through fractionation.

11. The method of claim 1, wherein the formed web of material has a solid content ranging from 5% to 50%.

12. The method of claim 11, wherein the formed web of material has a solid content ranging from 8% to 17%.

13. The method of claim 1, wherein the at least one first medium has a dry weight content ranging from 1 to 10 grams per square meter of surface area of the web of material.

14. The method of claim 1, wherein the at least one first medium comprises a color coating or a mineral filler material.

15. The method of claim 14, wherein the mineral filler material is selected from kaolin, clay, talcum, zeolite, $CaCO_3$ or $TiO_2$.

16. The method of claim 1, wherein the at least one second medium is selected from one or more of starch, a surface sizing agent, a latex, polyvinyl alcohol or an optical brightening agent.

17. The method of claim 1, further comprising applying the at least one first medium and the at least one second medium at a pressure ranging between 0.05 to 0.5 bar.

18. The method of claim 17, wherein the pressure ranges between 0.1 to 0.4 bar.

19. A method for applying an application medium to a moving web of material in a papermaking machine comprising:

forming a web of material in a twin wire area of a wet end section of the papermaking machine, wherein the web is produced from a material suspension in the twin wire area;

applying a medium with a plurality of wet end section applying devices to both sides of the web of material within the twin wire area of the wet end section of the papermaking machine;

moving the formed web of material to a press section of the papermaking machine;

applying a medium to both sides of the formed web of material in the press section with a plurality of press section applying devices after the web of material passes a first press nip of a press section of the papermaking machine.

20. A papermaking machine having a wet end section, a press section, a drying section and an applying device for applying a medium to a moving web of material comprising:

the wet end section including a twin wire area having a first wire and a second wire wherein the web of material is formed and positioned between the two wires and separated from the two wires before moving to the press section, wherein the web is produced from a material suspension in the twin wire area;

at least one wet end section applying device positioned on one side of at least one of the first wire or the second wire within the twin wire area and facing away from the web of material positioned on the wires; and the press section of the papermaking machine having a first press nip and at least one press section applying device arranged in the press section after the first press nip and facing directly toward the web of material.

21. The papermaking machine of claim 20, the at least one wet end section applying device further comprising at least one second applying device.

22. The papermaking machine of claim 20, the at least one press section applying device further comprising at least one second applying device.

23. The papermaking machine of claim 20, the drying section comprising at least one drying section applying device.

24. The papermaking machine of claim 20, the at least one wet end section applying device comprising at least one applicator.

25. The papermaking machine of claim 20, the at least one press section applying device is selected from at least one of an applicator, a spray nozzle or a pair of press rolls.

26. The papermaking machine of claim 20, the at least one drying section applying device is selected from at least one of an applicator, a spray nozzle or a pair of press rolls.

27. An apparatus for applying a medium to a moving web of material in a papermaking machine comprising:

a wet end section of a papermaking machine having twin wires for forming the web, wherein the web is produced from a material suspension in an area of the twin wires;

a plurality of wet end section applying devices arranged to apply a medium to both sides of the web of material;

the plurality of wet end section applying devices being arranged in the wet end section adjacent the twin wires;

a press section of a papermaking machine including a plurality of press nips;

a plurality of press section applying devices arranged in the press section to apply a medium to both sides of the web of material; and the plurality of press section applying devices being arranged after at least a first press nip of the plurality of press nips.

* * * * *